US005186628A

United States Patent [19]

Newman

[11] Patent Number: 5,186,628

[45] Date of Patent: Feb. 16, 1993

[54] PORTABLE DECOY DEVICE

[75] Inventor: Alan C. Newman, Bridport, United Kingdom

[73] Assignee: Bridport Aviation Products Limited, Dorset, United Kingdom

[21] Appl. No.: 737,978

[22] Filed: Jul. 30, 1991

[30] Foreign Application Priority Data

Aug. 9, 1990 [GB] United Kingdom ..... 9017456

[51] Int. Cl.[5] ..... F41A 33/00

[52] U.S. Cl. ..... 434/11; 273/408; 273/409

[58] Field of Search ..... 434/11, 16, 19, 20, 434/23, 27; 43/2, 1; 273/348, 355, 407, 409

[56] References Cited

U.S. PATENT DOCUMENTS 2,395,914 3/1946 Scott ..... 273/348

4,842,284 6/1989 Rushing et al. ..... 273/407 X

FOREIGN PATENT DOCUMENTS 8907232 8/1989 World Int. Prop. O. ..... 273/407

OTHER PUBLICATIONS

American Rifleman, Jun. 1967, p. 97.

*Primary Examiner*—John J. Wilson

*Assistant Examiner*—Jeffrey A. Smith

*Attorney, Agent, or Firm*—Dennison, Meserole, Pollack & Scheiner

[57] ABSTRACT

This invention relates to decoy devices and in particular decoy devices which deceptively simulate target objects such as artillery pieces, armoured vehicles or aircraft. According to the invention there is proposed a decoy device comprising a two dimensional simulation of a target object appearing upon a flexible sheet to the reverse side of which there is fitted a support system of parallel poles, such poles arranged in parallel being affixed to the sheet so that together with the target sheet bearing the simulation, they can be rolled up for transportation.

13 Claims, 7 Drawing Sheets

PORTABLE DECOY DEVICE

This invention relates to decoy devices and in particular decoy devices which deceptively simulate target objects such as artillery pieces, armoured vehicles or aircraft.

Such decoy devices, in order successfully to deceive an observer who is sited to their front, do not always need to simulate the whole of a gun, a tank or an aircraft. All that is required is that they should present to the observer, that which the observer is expecting to see. For example a gun is normally deployed in a gun pit and perhaps only the barrel is visible to a frontal observer. In the case of an armoured vehicle such as a tank the frontal observer may well expect that the tank will be located "hull-down" behind some sort of cover so that only its gun turret will be visible to the observer. Accordingly the term "decoy device" used herein is intended to represent not only devices representing whole target objects, such as entire guns, aircraft or tanks, but also parts of such target objects.

According to the invention it is proposed that such a decoy device shall comprise a two dimensional simulation of a target object appearing upon a flexible sheet to the reverse side of which there is fitted a support system of parallel poles, such poles arranged in parallel being affixed to the sheet so that together with the target sheet bearing the simulation, they can be rolled up for transportation.

The rolling discourages the formation of creases. When the decoy is to be deployed, it is unrolled, whereupon the decoy can be erected at any desired disposition or inclination relative to the ground, using guy ropes. It then constitutes a target and the intention is that the opposing force should be tempted to waste ammunition engaging such target.

The simulated image may be created with the aid of photography, and the photographic image may be mounted, for example by any suitable standard printing process, on a flexible sheet for example of polyester. On the reverse side of this sheet will be affixed the poles which are in parallel to allow the decoy to be rolled for storage and transportation.

Advantageously the poles, (which may be rods of plastics material, for example glass reinforced plastics) each have one end entered into a preformed blind pocket arranged on the reverse side of the target sheet (the sheet bearing the decoy image on its front face). The opposite end of each pole may pass through sleeve-like pockets and then protrude from the edge of the target sheet. The poles may be glued to that sheet or to one or more of the pole engaging pockets. The poles may have located on them eyelets or rings to which guy ropes may be led or, as will be seen below, such rings may be employed to locate transverse bracing rods. Once the poles have been semi-permanently affixed to the target sheet, a backing sheet is advantageously applied and glued or otherwise affixed to the reverse side of the target sheet.

Bracing rods may be provided which can be fitted to the decoy device and which cooperate with some of the parallel poles, extending transversely thereof, to tension the sheet with the image thereon. When the decoy is to be deployed, it is unrolled, and the rods are then affixed in place and employed to brace apart two or more of the poles which are arranged in parallel so as to stretch the target sheet. The connections between the poles and the bracing rods may be by T-pieces carried on the poles which are braced apart. The bracing rods may pass through rings located on the poles which are arranged in parallel. Preferably, the bracing rods will be of the same material and construction as the poles.

If the decoy devce is disposed vertically erect, it may be possible to dispense with the bracing rods, and to rely solely upon the parallel poles and upon the guy ropes to hold the decoy device such that an acceptably deceptive decoy image will be presented to an observer whom it is intended to deceive. When it is so vertically disposed the exposed ends of the poles of the decoy may stand on the ground or they may penetrate the ground surface.

In the case of a decoy device simulating an aircraft or a helicopter it may be that the intention is to deceive an observer in an overflying aircraft. In this case the two dimensional decoy image will again comprise a sheet bearing the image and held stretched out by means of poles and braces. In this circumstance the image will be a plan view and the sheet bearing it will be disposed generally horizontally. Preferably however such an image will be raised from the ground through a small distance so as to give something of a three dimensional effect as viewed by the intended observer. Again guy ropes and stakes will hold the image in the intended disposition, preferably raised above the ground.

To the decoy device as above proposed and in particular to the poles, there may be fitted means reflective of radar or infra red wavelengths, so that a desired radar or thermal signature may be obtained, thus promoting the deceptive effect.

The invention extends also to a kit of parts comprising a decoy as above described and comprising a two dimensional simulation of a target object appearing upon a flexible sheet to the reverse side of which there is fitted a support system of parallel poles, such poles arranged in parallel being semi-permanently affixed to the target sheet so that together with the sheet bearing the simulation, they can be rolled up for transportation; and in conjunction therewith, a bag having a compartment into which the decoy may be placed in rolled up condition, so as to be totally housed in the bag.

Such a bag will have sufficient pouches to house respectively, any bracing rods provided; tent pegs for the guy ropes; a mallet for driving such tent pegs; a repair kit; and a set of written installation instructions. Preferably the guy ropes are left tied to the decoy; but if they are separate, then the bag will have pouch space for carrying the guys. Such a bag may be provided with at least one carrying handle and a shoulder strap. It will be fabricated mainly of canvas and webbing and it will be equipped where appropriate with buckle closures for its pouches and with a drawstring for closing its main rolled decoy holding compartment.

The bag may have a near infra red signature. This may be achieved by incorporating one or both of carbon or a metal in its fabric; or it may be coloured with a dye which includes a substance reflective of infra red wavelengths.

One embodiment of the invention will be described by way of example with reference to the accompanying drawings in which.

Figure 2:
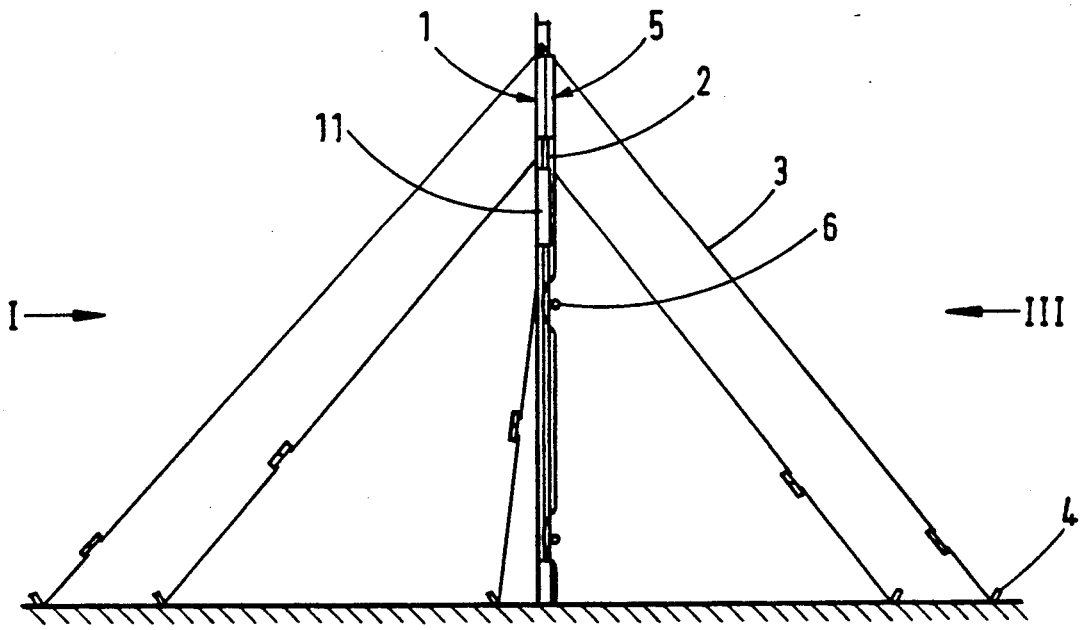
FIG. 2 is a representational or diagrammatic side view, in part, in cross-section taken on the lines II—II of FIG. 1.
Figure 3:
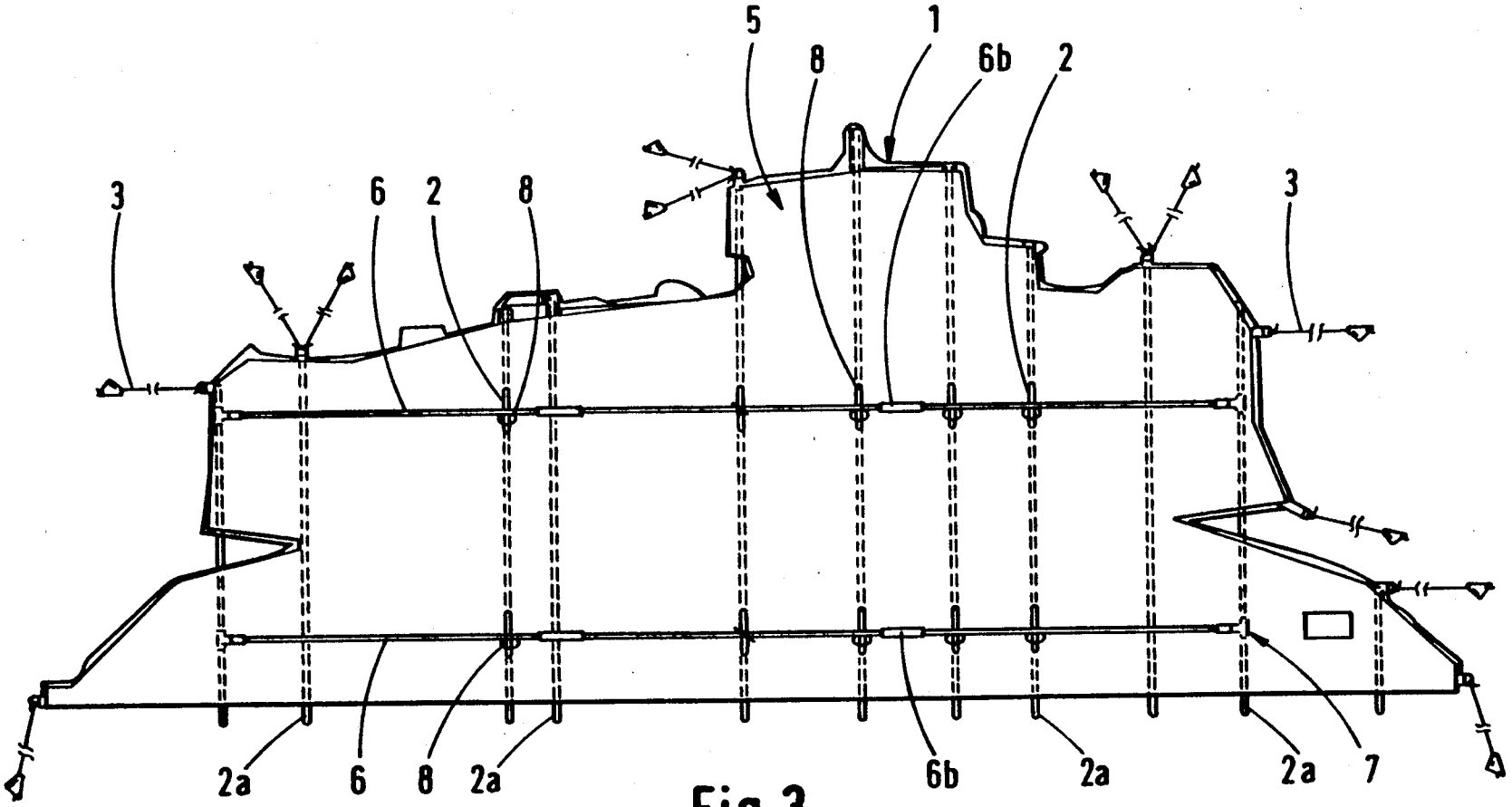
FIGS. 3 to 5 are rear views of the decoy depicted in FIGS. 1 and 2.
Figure 4:
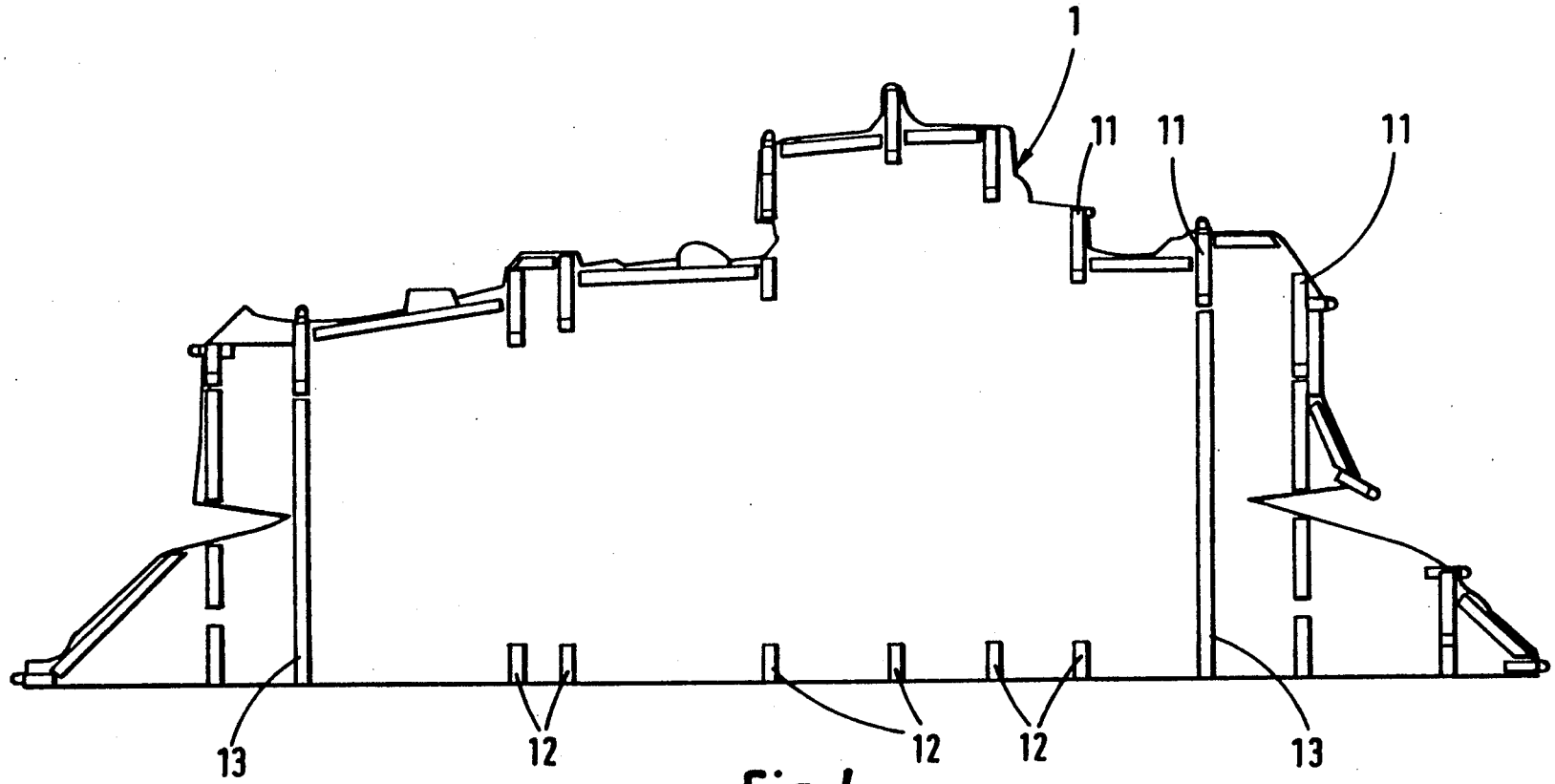
Figure 5:
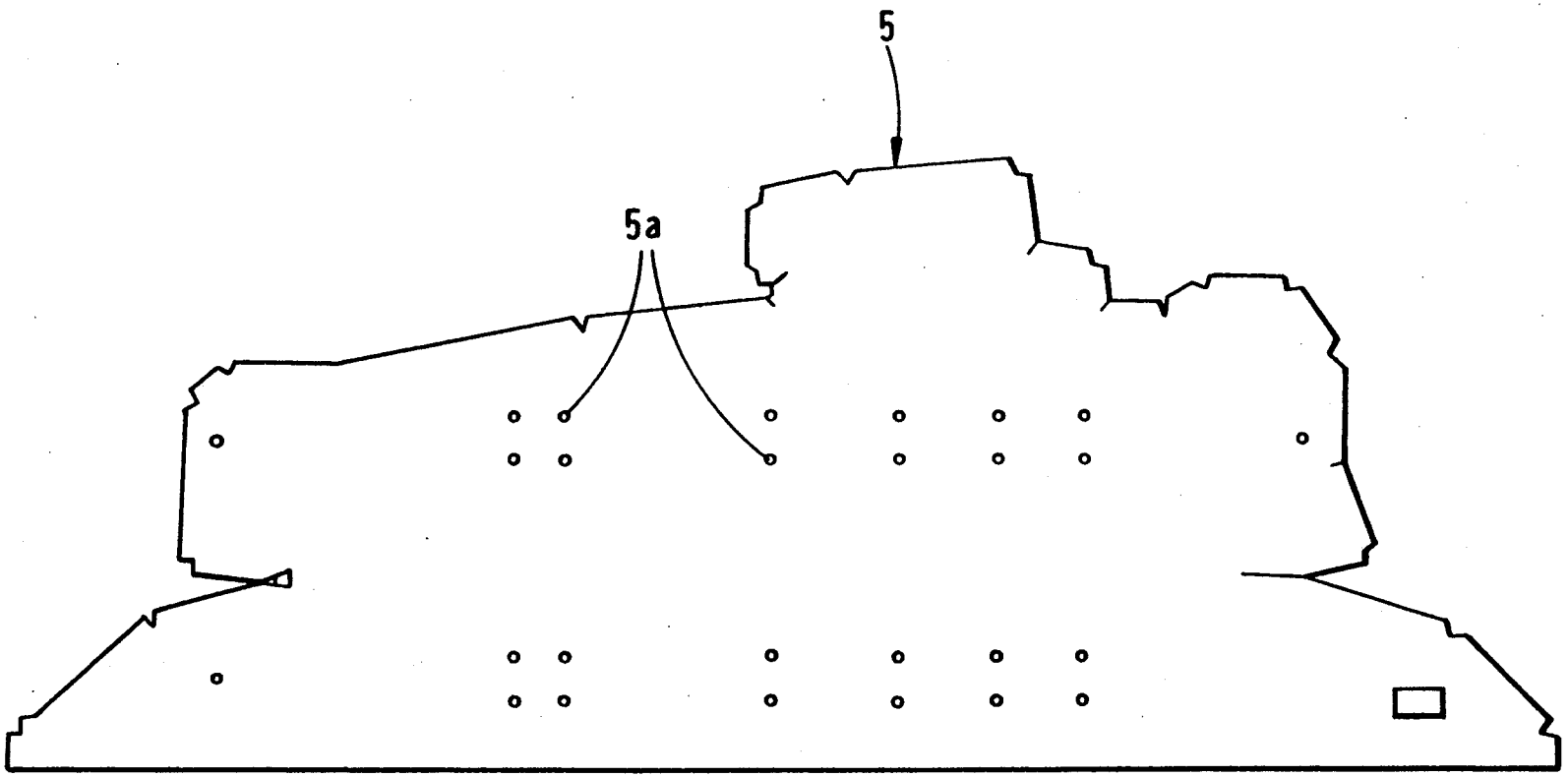

FIG. 3 being a rear view of the completed assembly as seen in the direction of the arrow III in FIG. 2;

FIG. 4 being a rear view of the reverse side of a sheet whose frontal face (seen only in FIG. 1) bears the decoy image; and FIG. 5 being a rear view of a backing sheet which is optionally fixed behind the essential image bearing sheet sheet depicted in FIG. 4.

Figure 6:
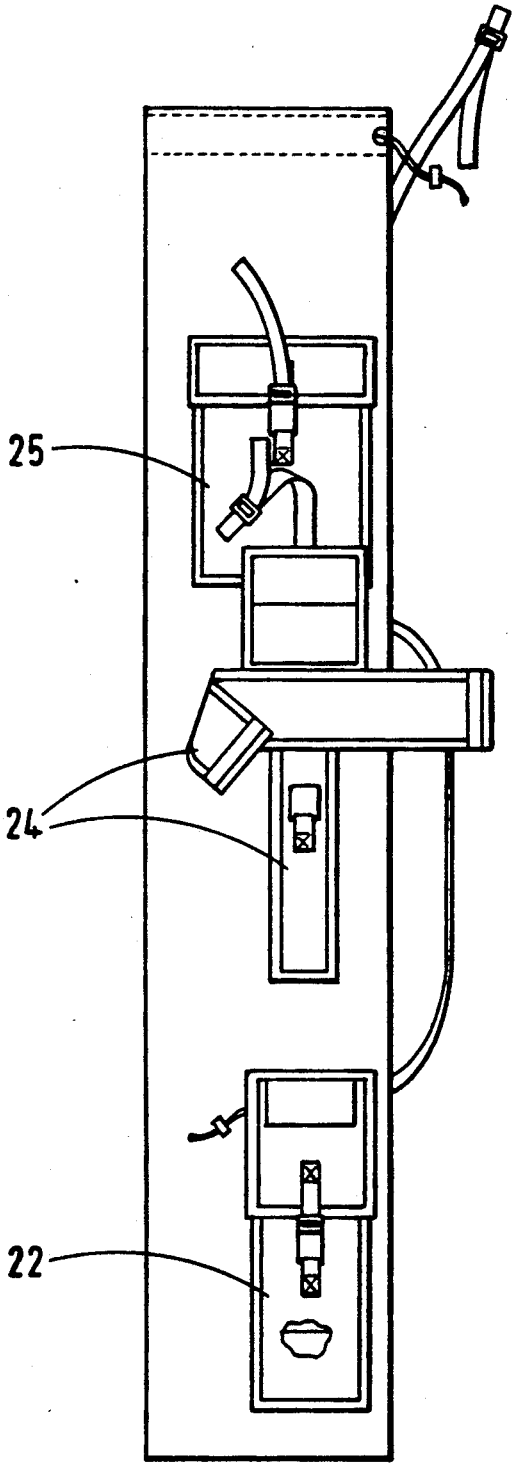
Figure 7:
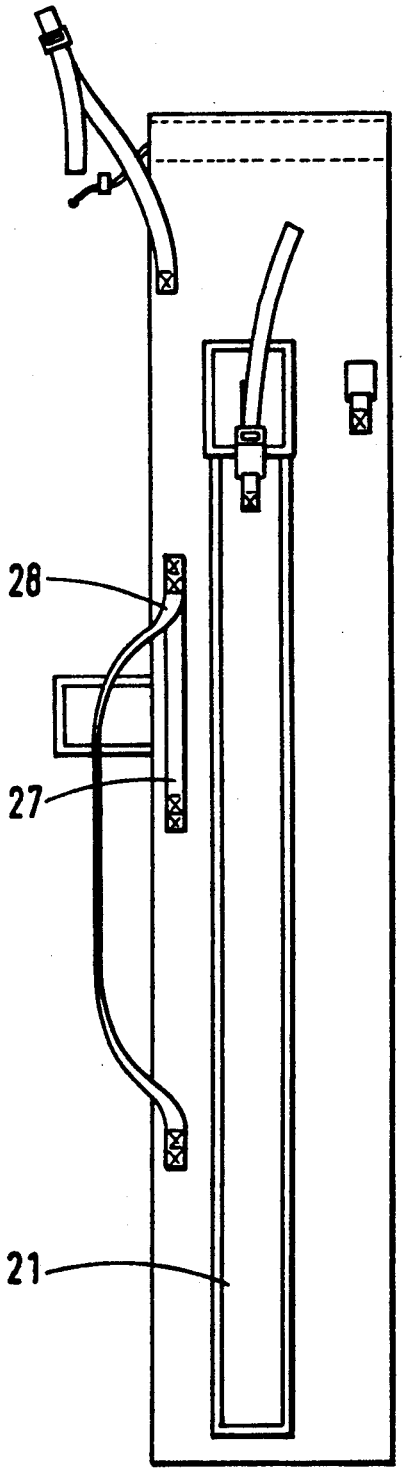
Figure 8:
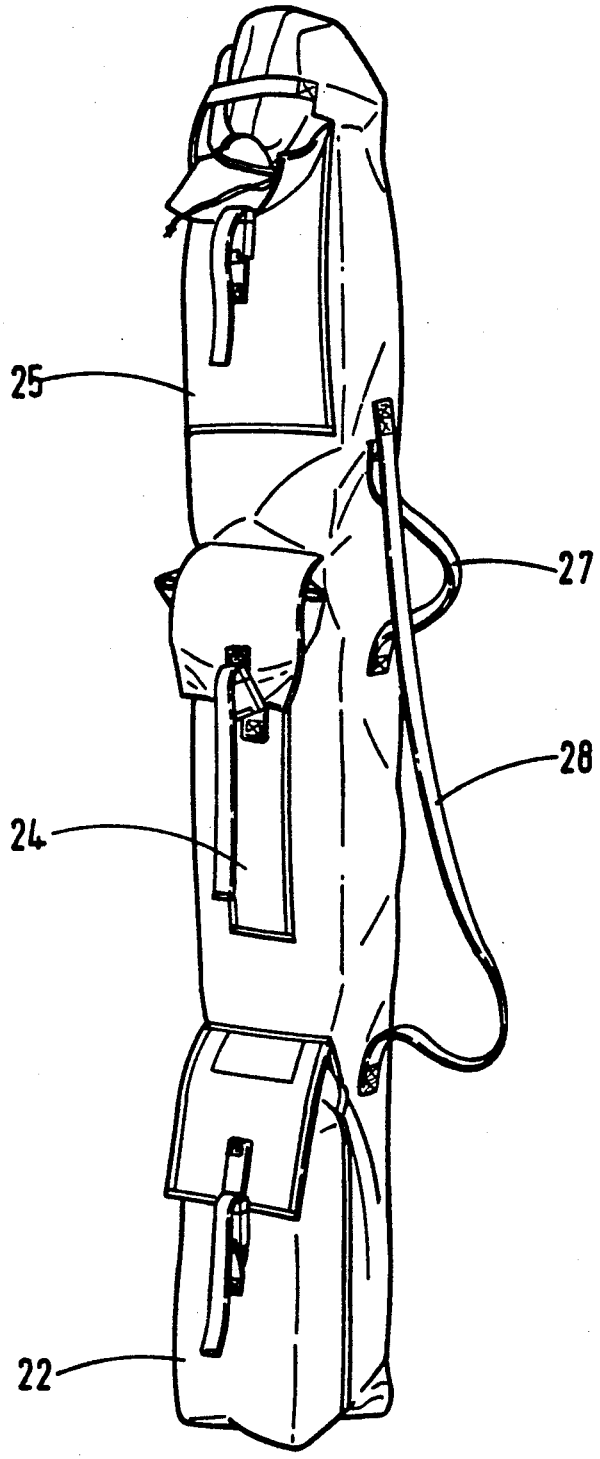

FIGS. 6 to 8 are views of a container bag for transporting the decoy depicted in FIGS. 1 to 5;

FIG. 6 being a front view;

FIG. 7 being a rear view; and

FIG. 8 being a perspective view from the front and side.

Figure 9:
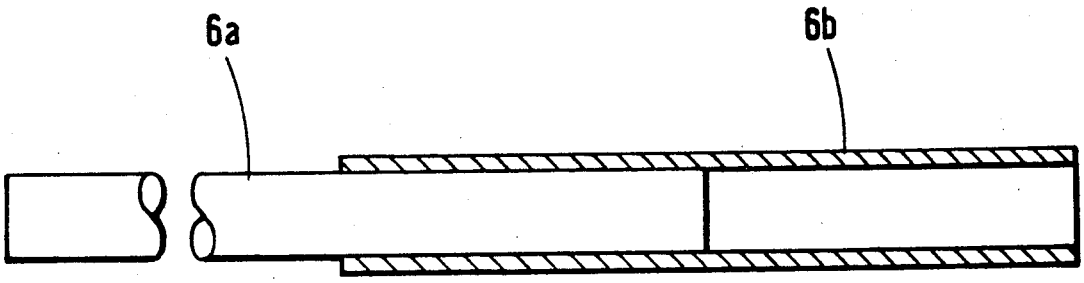
Figure 10:
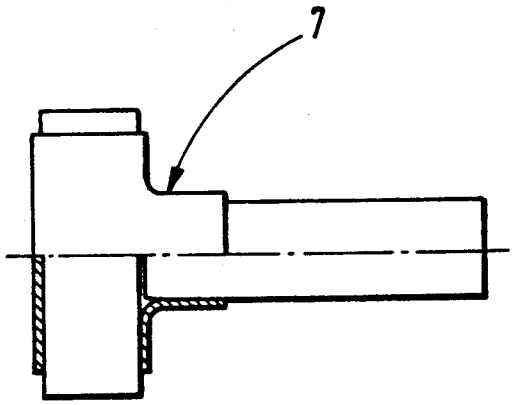

FIGS. 9 and 10 are detail views of rods bracing members and connecting T-pieces.

Figure 1:
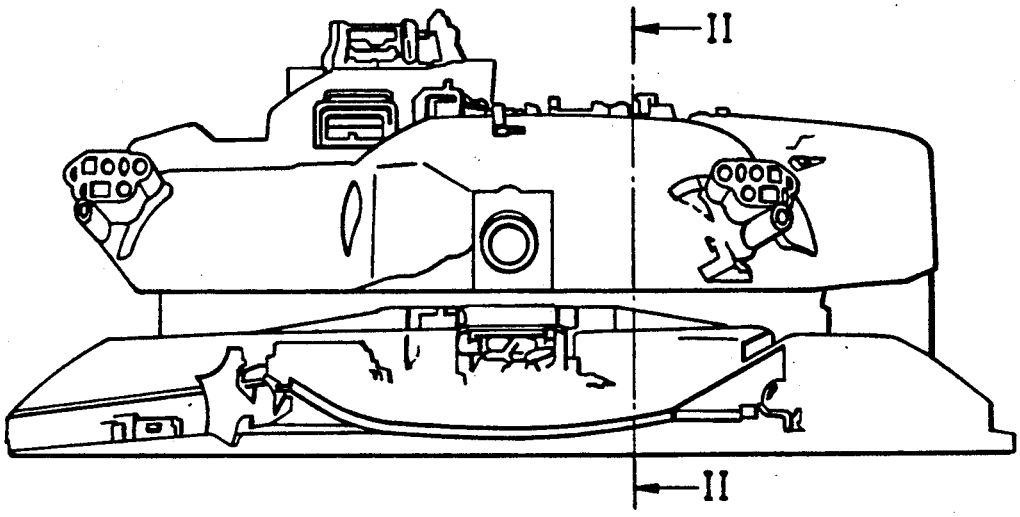
FIG. 1 is a frontal view of an erected decoy as seen in the direction of the arrow I in FIG. 2.

Referring first to FIGS. 1 and 2, there is shown a decoy as it is constituted when in an erected condition. The view of the decoy as depicted in FIG. 1 is an image simulating an armoured vehicle, when hull down in a pit or behind a bund, with its main armament appearing as if it is aimed at the observer. However when viewed from the side, and as shown in more detail in FIG. 2, the decoy or simulated target, is seen in reality to be a sheet 1 supported on poles 2 and sustained in erected condition by guy ropes 3 and tent or anchor pegs 4, element numeral 5 being an optional backing sheet.

The image sheet 1 will have on its frontal face, when looked at in the direction of the arrow I of FIG. 2, the decoy image which appears in FIG. 1; and on its reverse side as will be further described below, it will have affixed to it, a set of poles arranged parallel to one another, thses poles 2 being disposed vertically when the device is in the erected condition as depicted in FIGS. 1 and 2, the poles 2 and the image sheet 1 then being supported by the guy ropes 3 anchored by the pegs 4. As will be well understood, the guy ropes are adjustable as to their lengths in well known manner.

Referring now to FIGS. 3 to 5, and first in particular, to FIG. 4, the image sheet 1 is cut out to conform generally with the full size silhouette of the target which it is intended to simulate.

The simulated image may be created with the aid of photography, and the photographic image may be mounted, for example by any suitable standard printing process, on the flexible sheet 1 which may be made for example of polyester. On the reverse side of this sheet 1 are affixed the poles 2 which are in parallel to allow the decoy to be rolled for storage and transportation.

Advantageously the poles 2, (which may be rods of plastics material, for example glass reinforced plastics) each have one end entered into a preformed blind pocket 11 arranged at the upper edge of the reverse side of the target sheet 1 (the sheet bearing the decoy image on its front face). The opposite end of each pole 2 passes through sleeve-like pockets 12 arranged at or near the lower edge of the sheet 1 and then protrudes, as indicated at 2a in FIG. 3, from the edge of the target sheet, that is its lower edge when the sheet is in the erected condition.

Three of the poles, in the embodiment illustrated pass through elongate sleeve-like pockets 13. The poles may have located on them eyelets or rings 8 to which some of the guy ropes 3 may be led. The poles 2 are preferably glued to one or more of the pole engaging pockets 12 and 13. Before or after the poles 2 have been thus semi-permanently affixed to the target sheet 1, a backing sheet 5 is advantageously applied and glued or otherwise affixed to the reverse side of the target sheet. The outer peripheral edges of the sheets 1 and 5 may be stitched together and this border may be reinforced. Most of the guy ropes 3 are led to anchorage rings affixed at this border at predetermined locations thereof.

The backing sheet 5 is preferably a simple sheet of polyamide coated with polyurethane and this coating may contain together with colour pigments or dyes (chosen to give a camouflage effect) a substance reflective of near infra red and/or radar wavelengths, all so that a predetermined detectable signature may be provided for the decoy device. As will be seen from FIG. 5, the sheet 5 may be preformed with holes 5a through which certain of the poles 2 pass in and out.

As will be seen in FIG. 3, bracing rods 6 may be provided which can be fitted to the decoy device and which cooperate with the parallel poles 2 to tension the sheet 1 with the image thereon. When the decoy is to be deployed, it is unrolled, and the rods 6 are then affixed in place and employed to brace apart the poles 2 arranged in parallel. The connections between some of the poles 2 and the bracing rods 6 may be by T-pieces 7 (see also FIG. 10) carried on the poles 2.

The bracing rods 6 may pass through the rings 8 located on the poles which are arranged in parallel, and where there is a backing sheet 5, these rings 8 are suitably located where the poles 2 pass outside the rear face of the sheet 5, having been passed through the holes 5a therein. The bracing rods 6 will usually be of the same material and construction as the poles 2.

If the decoy device is disposed vertically erect, it may be possible to dispense with the bracing rods 6, and to relay solely upon the parallel poles 2 and upon the guy ropes 3 to hold the decoy device such that an acceptably deceptive decoy image will be presented to an observer whom it is intended to deceive. When it is so vertically disposed the exposed ends at 2a of the poles 2 of the decoy may stand on the ground or they may penetrate the ground surface.

As will be seen from FIG. 9, the rods 6 may be constituted by short rod elements 6a which are connected to other rod elements by sleeve connectors 6b, these components being of plastics material, as are the T-piece connectors 7, one of which is depicted in FIG. 10.

The invention extends also to a kit of parts comprising a decoy as above described and comprising a two dimensional simulation of a target object appearing upon a flexible sheet 1 to the reverse side of which there is fitted a support system of parallel poles 2, such poles arranged in parallel being semi-permanently affixed to the target sheet so that together with the sheet bearing the simulation, they can be rolled up for transportation; and in conjunction therewith, a bag defining an elongate internal compartment into which the decoy may be placed in rolled up condition, so as to be totally housed in the bag. Such a bag is depicted in FIGS. 6, 7 and 8.

Apart from its main elongate internal compartment, such a bag has external pouches respectively, as follows:

- a pouch 21 for any bracing rods provided;
- a pouch 22 for tent pegs;
- a pouch 24 for a mallet for driving such tent pegs;
- a pouch 25 for a repair kit and for a set of written installation instructions.

Preferably the guy ropes 3 are left tied to the sheet 1 of the decoy; but if they are separate, then the bag will have sufficient pouch capacity for carrying the guys.

Such a bag is be provided with at least one carrying handle 27 and a shoulder strap 28. It is fabricated mainly of canvas and webbing and it will be equipped where appropriate with buckle closures for its pouches and with a drawstring for closing its main rolled decoy holding compartment. FIG. 8 depicts the bag in buckled up condition with the rolled decoy being housed in the main central compartment of the bag ready for transportation.

The bag may have a near infra red signature. This may be achieved by incorporating one or both of carbon or a metal in its fabric; or it may be coloured with a dye which includes a substance reflective of intra red wavelengths.

I claim:

1. A decoy comprising a flexible target sheet having a front face and a reverse side, and an upper edge and a lower edge, a two dimensional simulation of a target object on said front face, a support system of spaced parallel poles, means for affixing said poles to said target sheet whereby said target sheet and said poles can be rolled up for transportation, said means for affixing said poles to said sheet comprising sleeve-like pockets on said reverse side adjacent said lower edge, and blind pockets on said reverse side vertically spaced above and aligned with said sleeve-like pockets, each of said poles having an end engaged in one of said blind pockets and extending therefrom through one of said aligned sleeve-like pockets, each pole extending below said lower edge of said target sheet.

2. A decoy as defined in claim 1, wherein said flexible target sheet is of synthetic plastic material, said simulation being a photographic image mounted by a printing process on said flexible target sheet.

3. A decoy according to claim 1 wherein each pole is glued to at least one of the pockets receiving the pole.

4. A decoy according to claim 1 including eyelets for guy ropes located at selected portions of said edges.

5. A decoy according to claim 1 including a backing sheet affixed to said reverse side of said target sheet, said backing sheet having slots therein, said poles selectively passing through said lots in said backing sheet.

6. A decoy according to claim 1 including bracing rods fixed to and extending transversely of said parallel poles.

7. A decoy according to claim 6 including T-shaped connections between selected poles and selected bracing rods.

8. A decoy according to claim 1 wherein said poles below said lower edge have exposed ends engagable in the ground.

9. A decoy according to claim 1 including means for reflection of radiation to obtain a desired radiation signature and promote a deceptive effect.

10. In combination, a decoy comprising a flexible target sheet having a front face and a reverse side, a two dimensional simulation of a target object appearing on said front face, a support system of parallel poles, means for affixing said poles in parallel and semi-permanently to the target sheet whereby said target sheet and said poles can be rolled up for transportation; and a bag having a compartment into which the decoy is received in rolled up condition so as to be totally housed in said bag, said bag being fabricated principally of fabric and including a near infra red signature material selected from the group consisting of carbon, metal and infra red reflective dye.

11. The combination of claim 10 wherein said target sheet includes marginal edge portions with rings, and guy ropes affixed to said rings.

12. The combination of claim 10 wherein said bag has external pouches to house bracing rods, tent pegs for guide ropes, a mallet for driving tent pegs, a repair kit and a set of written installation instructions.

13. The combination of claim 12 wherein said bag is provided with at least one carrying handle and a shoulder strap, the bag being fabricated mainly of canvas and webbing and being equipped with buckle closures for said pouches and a draw string for closing said decoy compartment.

* * * * *